United States Patent [19]

Fenick et al.

[11] Patent Number: 4,751,959

[45] Date of Patent: Jun. 21, 1988

[54] METHOD OF AND APPARATUS FOR CONTINUOUSLY CASTING METALS

[75] Inventors: Sol Fenick, Fair Lawn, N.J.; Carl Langner, Monsey, N.Y.

[73] Assignee: SMS Concast Inc., Montvale, N.J.

[21] Appl. No.: 937,448

[22] Filed: Dec. 5, 1986

Related U.S. Application Data

[63] Continuation of Ser. No. 686,716, Dec. 27, 1984, abandoned.

[51] Int. Cl.[4] ..... B22D 11/124

[52] U.S. Cl. ..... 164/486; 164/444; 164/477; 164/5; 164/461

[58] Field of Search ..... 164/485, 443, 444, 486, 164/487, 484, 457, 477, 5, 461; 264/557

[56] References Cited

U.S. PATENT DOCUMENTS

| | | | |
|---|---|---|---|
| 2,363,695 | 11/1944 | Ruppik | 164/485 X |
| 2,759,231 | 8/1956 | Parlanti | 164/342 X |
| 3,128,513 | 4/1964 | Charlton et al. | 164/486 |
| 3,468,361 | 9/1969 | Fromson | 164/485 |
| 3,658,117 | 4/1972 | Fromson | 164/486 |
| 4,510,989 | 4/1985 | Mayer | 164/415 |

FOREIGN PATENT DOCUMENTS

| | | | |
|---|---|---|---|
| 863161 | 9/1981 | U.S.S.R. | 164/444 |

*Primary Examiner*—Kuang Y. Lin

*Attorney, Agent, or Firm*—Peter K. Kontler; Tobias Lewenstein

[57] ABSTRACT

Molten metal is continuously teemed from a ladle into a tundish. The latter feeds a continuous stream of the molten metal to a cooled mold having opposite open ends connected by a casting passage. The molten metal enters the mold at one end and partially solidifies in the casting passage to form a continuously cast strand which is withdrawn from the mold at its other end. The strand initially consists of a thin shell of solidified metal, and a molten core which is confined by the shell. Upon leaving the mold, the strand is conveyed through a bath of molten metal. The metal of the bath has a lower melting point than, and a specific gravity comparable to that of, the metal being cast. The bath functions to cool the strand uniformly so that the quality of the strand is maintained. The bath further counteracts the tendency of the molten core to cause bulging of the solidified shell which also serves to enhance the quality of the strand. Additional enhancement of the quality of the strand is obtained by virtue of the fact that the bath protects the strand from the atmosphere. The strand leaves the bath after the molten core has solidified and is then cut into sections for further processing.

32 Claims, 6 Drawing Sheets

METHOD OF AND APPARATUS FOR CONTINUOUSLY CASTING METALS

This application is a continuation of application Ser. No. 686,716, filed Dec. 27, 1984 now abandoned.

BACKGROUND OF THE INVENTION

The invention relates generally to continuous casting. More particularly, the invention relates to the continuous casting of metals, especially steel.

In the continuous casting of steel, molten steel is teemed into one end of a mold having opposite open ends, and a strand consisting of a solidified shell and a molten core is withdrawn from the other end of the mold. Upon exiting from the mold, the strand is sprayed with water, or a mixture of water and air, in order to solidify the molten core.

The great majority of continuous casting machines currently in use have vertical molds, and the molten steel is teemed into the upper end of the mold while the continuously cast strand is withdrawn from the lower end of the mold. The strand follows a downward path which, depending upon the type of machine, may be straight or curve towards the horizontal. In either event, significant pressure develops inside the strand when the cross section of the latter is large. This is due to the fact that the rate at which heat can be removed from a strand is limited so that, for a large strand, the core remains molten for a substantial distance from the mold. The pressure generated by the molten core, which may be referred to as the metallostatic pressure, is a function of the specific gravity of the steel being cast and the head of the molten steel, that is, the vertical distance from the mold.

In order to counteract the metallostatic pressure, continuous casting machines for large strands have roller aprons which receive the strand as it issues from the mold. The roller aprons, which consist of two series of rollers located on opposite sides of the strand, generally extend from the mold to at least that point along the path of the strand where the molten core has solidified completely. The cooling medium is sprayed onto the strand through the spaces between neighboring rollers. The roller aprons also perform a guiding function.

One of the drawbacks of conventional continuous casting machines for large strands resides in that the roller apron adds significantly to the cost and complexity of the machine. An important factor in the cost and complexity of the roller apron is the requirement that it be able to withstand the substantial metallostatic pressure of the molten core. Furthermore, although the roller apron counteracts the metallostatic pressure at the points of contact between the rollers and the strand, the metallostatic pressure causes bulging of the strand in the spaces between neighboring rollers. Accordingly, as the strand travels along the roller apron, the shell of the strand bulges outwards in the spaces between neighboring rollers and is subsequently pushed inwards by the rollers. The alternating stresses generated in this manner may lead to defects in the strand.

Conventional continuous casting machines, including machines for small strands, also have a host of drawbacks related to the spray cooling of the strand. One such drawback is that homogeneous cooling is very difficult to achieve. Non-homogeneous cooling is another source of defects in continuously cast strands.

Furthermore, non-homogeneous cooling results in distortion of the geometric shape of the strand.

Another drawback related to spray cooling is that the spray nozzles tend to become clogged. This not only enhances non-homogeneous cooling of the strand but adds to maintenance costs.

Moreover, the surface of the stand oxidizes during spray cooling. The scaling which accompanies oxidation results in loss of material. Oxidation also adversely affects surface quality so that a surface layer of the strand must be removed after casting when good surface quality is required, e.g. when casting certain steel grades. This not only entails a further loss of material but increases labor costs as well. In addition, the scale generated during spray cooling must be periodically removed from the machine which again adds to maintenance costs.

Since the water used for spray cooling becomes contaminated, a water treatment system is necessary. Such a system not only constitutes a substantial capital expenditure but also represents a significant maintenance item.

OBJECTS AND SUMMARY OF THE INVENTION

It is an object of the invention to provide a continuous casting method and apparatus which enable the pressure of a molten core to be counteracted more effectively than heretofore.

Another object of the invention is to provide a continuous casting method and apparatus which enable the expense associated with a roller apron to be reduced.

An additional object of the invention is to provide a continuous casting method and apparatus which enable more uniform cooling to be achieved.

A further object of the invention is to provide a continuous casting method and apparatus which enable the expenses associated with spray cooling to be reduced.

It is also an object of the invention to provide a continuous casting method and apparatus which enable material losses to be reduced.

Yet another object of the invention is to provide a continuous casting method and apparatus which enable strand quality to be improved.

The preceding objects, as well as others which will become apparent as the description proceeds, are achieved by the invention.

A continuous casting apparatus according to the invention comprises the following:

A. A mold having an inlet end for molten material, e.g. steel, and an outlet end for a continuously cast strand of the material.

B. Withdrawal means for withdrawing the strand from the mold and conveying the strand along a predetermined path.

C. Cooling means for cooling the strand downstream of the mold. The cooling means includes container means, and a non-gaseous cooling substance in the container means surrounding and contacting at least a portion of the path of the strand. The cooling substance has a lower melting point than the material of the strand.

A continuous casting method in accordance with the invention comprises the following steps:

A. Continuously introducing molten material, e.g. steel, into one end of a casting passage having another end which is spaced from the one or inlet end thereof.

B. Cooling the material in the casting passage to form a strand having a solidified shell, and a molten core confined by the shell.

C. Continuously withdrawing the strand from the casting passage via the other or outlet end thereof.

D. Cooling the strand prior to solidification of the core by immersing the strand in a bath.

An important feature of the method and apparatus of the invention is that the strand is immersed in a bath subsequent to leaving the mold. Since the pressure of the bath at least partly counteracts the pressure of the molten core, the structural requirements for any guide means which may be disposed in the bath need not be as strict as those for the roller aprons of the prior art. The effect of the bath may be enhanced by making the bath of a substance having a specific gravity comparable to that of the material being cast. Further enhancement of the effect of the bath is possible by arranging for the surface of the bath to be located near or at the level of the mold. Under such circumstances, bulging of the strand may be entirely or almost entirely suppressed by the bath alone. Suppression of bulging by the bath and the accompanying reduction or elimination of stresses in the solidified shell permit improvements in quality to be obtained.

Cooling of the strand in a bath has the further advantage that the uniformity of cooling may be increased. Again, this leads to improvements in quality, including better conformance of the strand to the desired geometric shape. Appropriate selection of the thermal conductivity of the bath also enables cooling to proceed at a relatively rapid rate which, in turn, makes it possible to cast at a relatively high speed. Moreover, by designing the bath so that the temperature of the strand has been reduced to the proper level before the strand leaves the bath, spray cooling of the strand may be eliminated. This makes it possible to dispense with a water treatment system, and further eliminates the maintenance problems and costs associated with spray cooling. In addition, suitable selection of the composition of the bath enables oxidation of the surface of the strand to be reduced so that improvements in surface quality may be obtained. Scaling of the strand may also be reduced thereby reducing material losses and the frequency with which scale must be removed from the apparatus.

The novel features which are considered as characteristic of the invention are set forth in particular in the appended claims. The improved continuous casting apparatus itself, however, both as to its construction and its mode of operation, together with additional features and advantages thereof, will be best understood from a perusal of the following detailed description of certain specific embodiments with reference to the accompanying drawings.

DESCRIPTION OF THE PREFERRED EMBODIMENTS

Figure 1:
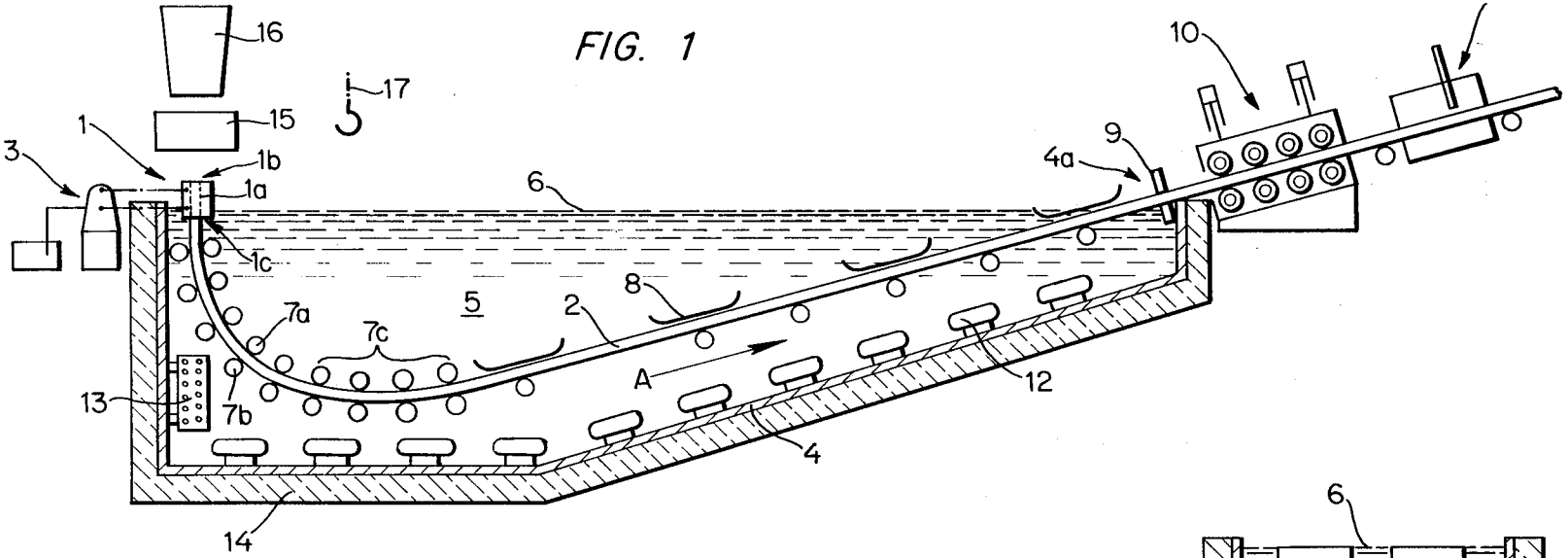
FIG. 1 is a schematic longitudinal sectional view of a continuous casting apparatus according to the invention.

FIG. 1 illustrates a continuous casting apparatus of the vertical mold type. The apparatus of FIG. 1, which is assumed to be designed for the continuous casting of steel, includes a mold 1 having a casting passage 1*a*. The mold 1 is shown as being of the curved type, and the casting passage 1*a* is accordingly curved. However, the mold 1 could just as well be provided with a straight casting passage. The casting passage 1*a* has an inlet end 1*b* through which molten steel is teemed into the mold 1, and an outlet end 1*c* through which a continuously cast strand 2 is withdrawn from the mold 1. The mold 1, which is entirely conventional and may be in the form of a tube mold or plate mold, is cooled in a manner known per se. A conventional oscillator 3 is connected with the mold 1 and functions to reciprocate the latter during casting. The mold 1 is mounted on a non-illustrated casting platform in a manner known per se.

A tank 4 is disposed below the mold 1. The tank 4 is situated and designed in such a manner that a portion of the path A followed by the strand 2 after exiting the mold 1 is located in the tank 4. The tank 4 is filled with a substance 5 which serves to cool the strand 2 once the latter has left the mold 1. Preferably, the height of the tank 4 is such that the upper end of the tank 4 is at a level above the outlet end 1*c* of the mold 1. This makes it possible for the upper surface 6 of the substance 5 to be situated at or slightly above the outlet end 1*c* as shown.

Guide rollers 7*a* and 7*b* for guiding the strand 2 are disposed downstream of the mold 1 in the tank 4. The guide rollers 7*a* are located adjacent to that surface of the strand 2 which forms at the inner radius of the casting passage 1*a* while the guide rollers 7*b* are located adjacent to that surface of the strand 2 which forms at the outer radius of the casting passage 1*a*. Certain ones of the guide rollers 7*a*,7*b* cooperate to define a straightening section 7*c* which eliminates the curvature imparted to the strand 2 during formation of the latter in the curved casting passage 1*a*.

The guide rollers 7*b* continue beyond the straightening section 7*c*. The guide rollers 7*a*, on the other hand, are replaced by skids 8 downstream of the straightening section 7*c*.

The strand 2 leaves the tank 4 at an end 4*a* thereof remote from the mold 1. A scraping device 9 may be located at the discharge end 4*a* of the tank 4 in order to remove the substance 5 from the surfaces of the strand 2 and/or to form a relatively smooth coating of the substance 5 on the strand 2.

A conventional, reversible withdrawal unit 10 is mounted outside of the tank 4 downstream of the discharge end 4*a*. The withdrawal unit 10 serves to feed a non-illustrated dummy bar, which is known per se, into the mold 1 prior to casting, and further serves to convey the strand 2 along the path A.

A torch unit 11, which is likewise conventional, is disposed downstream of the withdrawal unit 10. The torch unit 11 functions to subdivide the strand 2 into sections.

The substance 5 may be solid at room temperature. In such an event, it is necessary to melt the substance 5 before proceeding with a cast. To this end, the tank 4 may accommodate a series of units 12 each of which includes a heating element. Any type of heating element capable of melting the substance 5 may be used. For example, the heating elements may be in the form of electrical resistance elements. Each of the units 12 may further include a pump for circulating the substance 5 subsequent to melting.

The heating elements need not be formed as units 12 with the circulating pumps, and it is possible for the heating elements to be separate from the circulating pumps.

In order to recover the heat removed from the strand 2, one or more heat exchangers 13 may be disposed in the tank 4. Circulation of an appropriate cooling medium, e.g. water, through the heat exchangers 13 during casting then permits at least part of the heat transferred from the strand 2 to the substance 5 to be recovered.

When the tank 4 is provided with heat exchangers 13 for the purpose of recovering the heat removed from the strand 2, it is desirable to reduce heat losses from the tank 4. This may be accomplished by surrounding the tank 4 with insulation 14.

The tank 4 is illustrated as being open at the top. However, it is entirely possible to enclose the substance 5 entirely by designing the tank 4 with a cover. A cover will reduce heat losses from the tank 4 and may also function to suppress the escape of fumes into the atmosphere should this be a problem.

The continuous casting apparatus of FIG. 1 operates as follows:

It is assumed that the substance 5 is a solid at room temperature and is initially in solid form. Heat is supplied to the heating elements of the heating and circulating units 12 in order to melt the substance 5. Once the substance 5 has melted so as to form a bath, the circulating pumps of the heating and circulating units 12 may be started.

A non-illustrated, conventional dummy bar is now fed towards the mold 1 by the withdrawal unit 10. The dummy bar is positioned so that the dummy bar head closes the outlet end 1*c* of the mold 1. The portion of the dummy bar remote from the dummy bar head remains engaged by the withdrawal unit 10.

A tundish 15 known per se is positioned above the mold 1. Once the dummy bar and the tundish 15 are in position and the dummy bar head has been sealed, a ladle 16 containing molten steel is transported to a location above the tundish 15 by a service crane 17. The ladle 16 is opened while the tundish 15 remains sealed, and molten steel is teemed from the ladle 16 into the tundish 15 until the latter has been filled to a predetermined level. The tundish 15 is now opened, and the molten steel is teemed from the tundish 15 into the inlet end 1*b* of the mold 1. The oscillator 3 is started and reciprocates the mold 1. Furthermore, cooling of the mold 1 is initiated.

When the molten steel in the mold 1 reaches a specified level, the withdrawal unit 10 is started in order to draw the dummy bar away from the mold 1. The initial quantity of molten steel to enter the mold 1, which constitutes the leading end of the strand 2, solidifies upon contact with the dummy bar head and forms a connection with the latter. Accordingly, the strand 2 is drawn out of the outlet end 1*c* of the mold 1 as the dummy bar is pulled away from the mold 1 by the withdrawal unit 10. Since the upper surface 6 of the bath formed by the substance 5 is at or above the level of the outlet end 1*c*, the strand 2 travels from the mold 1 directly into the bath. The strand 2 is thus prevented from coming into contact with the air at such time as the strand 2 is at its highest temperature which helps reduce oxidation of the strand 2.

Sufficient heat to maintain the substance 5 in liquid form is supplied by the heating elements of the heating and circulating units 12 during the interval between melting of the substance 5 and entry of the strand 2 into the bath formed by the substance 5. Circulation of a cooling medium through the heat exchangers 13 is avoided during this interval. When the strand 2 enters the bath, the heat output of the heating elements may be reduced. inasmuch as large quantities of heat are now transferred to the bath from the initially white-hot strand 2. Furthermore, circulation of a cooling medium through the heat exchangers 13 is begun upon entry of the strand 2 into the bath. Heat transmitted from the strand 2 into the bath is transferred to the cooling medium in the heat exchangers 13 by indirect heat exchange between the cooling medium and the bath. The cooling medium circulated through the heat exchangers 13 may be water, for example, and the heat recovered from the strand 2 may then serve to generate part or all of the hot water supply for the continuous casting facility.

As mentioned previously, the mold 1 is cooled in a conventional manner. Generally, the mold 1 will be cooled by circulating cool water through the same. Cooling of the mold 1 causes a thin layer of the molten steel adjacent to the walls of the casting passage 1*a* to solidify. This results in formation of the strand 2 which, when it first exits from the mold 1, consists of a very thin outer skin or solidified shell surrounding a molten core. The upper surface or meniscus of the molten core is located in the mold 1 and remains in this position while the contents of the ladle 16 are emptied into the mold 1. The molten core exerts a pressure on the solidified shell which is proportional to the vertical distance from the meniscus and tends to cause bulging of the solidified shell. However, in accordance with the invention, bulging of the solidified shell is resisted by the bath of the substance 5 which generates a pressure counteracting the pressure of the molten core. The effectiveness of the bath in counteracting the outward pressure of the molten core is enhanced by having the upper surface 6 of the bath located at the level of the mold 1. The reason is that the head of the bath at any point of the portion of the path A within the tank 4 is then almost the same as the head of the molten core at such point. The effectiveness of the bath in counteracting the outward pressure of the molten core may be further enhanced by selecting the substance 5 so that the specific gravity of the bath equals or approximates the specific gravity of the molten core.

As the strand 2 travels downwards, the metallostatic pressure due to the molten core increases since the head of the molten core increases. However, the pressure exerted by the bath likewise increases inasmuch as the depth to which the strand 2 is immersed in the bath, and hence the head of the bath, increases with downward movement of the strand 2.

Cooling of the strand 2 by the bath causes the thickness of the solidified shell to increase progressively as the strand 2 travels along the path A. Accordingly, the solidified shell becomes more and more capable of containing the molten core on its own. This effect is enhanced by the fact that the solidified shell becomes progressively cooler as the strand 2 advances so that the strength of the solidified shell also increases progressively. The increase in thickness of the solidified shell is accompanied by shrinking of the molten core.

Since the casting passage 1*a* is curved, the strand 2 is formed with an inherent curvature and tends to follow a curved path having a radius equal to that of the casting passage 1*a*. The guide rollers 7*a*,7*b* located upstream of the straightening section *7c* define a path segment which has a radius of curvature equal to that of the casting passage 1*a* and constitutes a continuation of the latter. On the other hand, the guide rollers 7*a*,7*b* of the straightening section *7c* define a path segment of continuously increasing radius as considered in downstream direction of the path A. Thus, when the strand 2 enters the straightening section *7c*, the strand 2 is unbent. The straightening section *7c* is designed in such a manner that the strand 2 is essentially straight upon leaving the straightening section *7c*. From the straightening section *7c*, the strand 2 is guided to the discharge end 4*a* of the tank 4 along an essentially linear path segment bounded by the guide rollers 7*b* and the skids 8. As the strand 2 exits from the tank 4, the surfaces of the strand 2 are scraped by the scraping device 9 in order to remove residues of the substance 5.

For a strand 2 of solid cross section, the casting speed or rate of advance of the strand 2; the length of the portion of the path A in the substance 5; the heat output of the heating elements constituting part of the heating and circulating units 12; and the rate of circulation of a cooling medium through the heat exchangers 13 are preferably selected in such a manner that the strand 2 is solidified throughout before leaving the bath.

After passing through the discharge end 4*a* of the tank 4, the strand 2 enters the withdrawal unit 10. Once the strand 2 has been engaged by the withdrawal unit 10, the strand 2 may be disconnected from the dummy bar. This may be accomplished in any conventional manner, e.g. by cutting the strand 2 immediately upstream of the dummy bar head using the torch unit 11. The strand 2 advances from the withdrawal unit 10 to the torch unit 11 where the strand 2 is cut into sections of predetermined length in a manner known per se. The cut sections are transported away from the torch unit 11 on a non-illustrated conveyor, e.g. a roller conveyor, for further processing as desired.

As described previously, one advantage of the bath of the substance 5 is the resistance offered to the metallostatic pressure of the molten core. Since the bath at least partially compensates for the metallostatic pressure, it follows that the guide rollers 7*a*, 7*b* and the skids 8 are less highly stressed than the roller aprons of the prior art which must bear the full effect of the metallostatic pressure. Furthermore, the buoyancy of the bath at least partly counteracts the weight of the strand 2 which further contributes to a reduction of the stresses imposed upon the guide rollers 7*b*. Accordingly, the guide means including the guide rollers 7*a*,7*b* and the skids 8 may be manufactured at a lower cost than the roller aprons of the prior art.

From a metallurgical point of view, there may be benefits to be realized when the height of the molten core is great. In conventional continuous casting apparatus, great height of the molten core can be obtained only at high cost due to the strength requirements which are imposed on the roller apron by the large head of molten metal The invention, on the other hand, makes it possible to achieve great height of the molten core relatively inexpensively The resistance of the bath to the metallostatic pressure of the molten core also reduces the bulging which a strand undergoes between neighboring rollers of a conventional roller apron. The reduction in bulging is accompanied by a decrease in the stresses and strains to which the solidified shell is subjected. As a result, improvements in quality may be obtained. For example, internal and external cracking of the strand 2 may be reduced. The improvements in quality may be enhanced by arranging the upper surface 6 of the bath to be at the level of the mold 1 and by selecting the specific gravity of the bath so that it is comparable to the specific gravity of the molten core. Under such circumstances, bulging of the strand 2 and defects associated with bulging may be virtually eliminated.

In conventional continuous casting apparatus, breakouts occur in a certain percentage of the strands. In other words, the metallostatic pressure and the resultant bulging cause the solidified shell of a certain percentage of the strands to rupture. This percentage may also be reduced in accordance with the invention.

A further advantage of the bath of the substance 5 is that it promotes uniform cooling of the strand 2. In the continuous casting apparatus of the prior art, the strand is sprayed with water, or a mixture of air and water, by means of spray nozzles. Generally, certain areas of the strand are oversprayed while others are undersprayed. This sets up thermal stresses in the strand which, in turn, lead to defects. The situation is aggravated when a spray nozzle becomes clogged during a cast since safety considerations prevent access to the spray nozzles while casting is being performed. The bath of the invention makes it possible to reduce, or even virtually eliminate, thermal gradients caused by non-uniform cooling. This enables additional improvements in quality to be obtained. Increased uniformity of cooling further helps to reduce distortion of the geometric shape of the strand 2.

The bath also permits cooling of the strand 2 to be very accurately controlled. This may be accomplished by appropriate regulation of the heat exchangers 13 and/or the heating elements constituting part of the heating and circulating units 12 and/or the circulating pumps constituting part of the units 12.

The bath of the substance 5 further functions to protect the strand 2 from the atmosphere. As a result, scaling of the strand 2 may be reduced which, in turn, decreases material losses. Moreover, inasmuch as reduced scaling of the strand 2 is accompanied by a reduction in the amount of debris deposited in the continuous casting apparatus, the costs associated with cleaning of the apparatus may be reduced. Improvements in the surface quality of the strand 2 may also be achieved by virtue of the fact that the bath maintains the strand 2 out of contact with the atmosphere.

Protection of the strand 2 from the atmosphere may be enhanced by arranging for the upper surface 6 of the bath to be located at the level of the mold 1 so that the outlet end 1*c* of the latter is disposed in the bath. The strand 2 is then prevented from coming into contact with the atmosphere when the strand 2 is at its highest temperature and most susceptible to oxidation. The surface quality of the strand 2 upon emergence from the bath may then be as good as when the strand 2 exited the mold 1.

The surface of the strand 2 may continue to be protected from the atmosphere after leaving the bath of the substance 5 if the latter is capable of forming a coating on the strand 2. The coating may be retained should this be necessary or desirable for further processing. On the other hand, if processing considerations dictate that the strand 2 be uncoated, the coating may be removed at any convenient time. Preferably, removal of the coating is carried out after the cut sections of the strand 2 have been transported away from the continuous casting apparatus. The coating may be removed in any conventional fashion. However, suitable selection of the substance 5 makes it possible to combine removal of the coating with another of the operations to which the cut sections of the strand 2 are subjected so that a separate operation for stripping the coating may be avoided. For example, the cut sections of the strand 2 may be rolled. The rolling of steel sections is generally preceded by a heating operation at about 1100° C. If zinc is used as the substance 5, the zinc coating which forms on the strand 2 may be evaporated during the preheating cycle since the boiling point of zinc is 907° C.

By appropriate selection of the rate of advance of the strand 2; the length of the portion of the path A in the bath of the substance 5; the heat output of the heating elements constituting part of the heating and circulating units 12; and the rate of circulation of a cooling medium through the heat exchangers 13, the temperature of the strand 2 upon leaving the bath may be sufficiently low that further cooling of the strand 2 in the continuous casting apparatus is unnecessary. Spray cooling of the strand 2 may then be avoided entirely. This not only eliminates the costs involved in keeping the spray nozzles unplugged and properly aligned but also makes it possible to dispense with a water treatment system.

The bath additionally offers the possibility of recovering heat from the strand 2. No heat recovery can be achieved with the spray systems of the prior art.

In addition, selection of the substance 5 so that the thermal conductivity of the bath is relatively high permits a relatively high rate of heat transfer between the strand 2 and the bath to be achieved. The resulting rapid removal of heat from the strand 2 makes it possible to achieve casting speeds higher than those which are obtainable for spray cooling.

The employment of a bath for cooling the strand 2 also opens a new avenue for the continuous casting of hollow sections. In accordance with the invention, this may be accomplished by allowing the strand 2 to travel upwards to a point higher than the level of the meniscus, i.e. the level of the upper surface of the column of molten metal in the mold 1. The casting speed or rate of advance of the strand 2; the length of the portion of the path A in the bath; the heat output of the heating elements constituting part of the heating and circulating units 12; and the rate of circulation of a cooling medium through the heat exchangers 13 are then selected in such a manner that the core of the strand 2 is still molten when the strand 2 reaches the level of the meniscus. Under such circumstances, the portion of the strand 2 above the meniscus will be hollow.

The method and apparatus of the invention have the further advantage that all required components are commercially available.

The substance 5 desirably has the following properties:

A. It should be non-flammable up to the melting point of the material being cast.

B. It should not undergo any type of reaction with the material being cast which adversely affects the properties of the ultimate products C. It should have a melting point which is so much lower than the melting point of the material being cast that a rate of heat transfer sufficiently high for the desired production rate may be achieved.

D. It should be solid or liquid at room temperature.

E. It should have a thermal conductivity of such large magnitude in the liquid phase that a rate of heat transfer sufficiently high for the desired production rate may be achieved.

In addition to these properties, the substance 5 preferably has a specific gravity in the liquid phase which is comparable to that of the molten material being cast. If the specific gravity of the substance 5 is far less than that of the material being cast, the bath may be unable to contain the molten core of the strand 2. On the other hand, if the specific gravity of the substance 5 far exceeds the specific gravity of the material being cast, the bath may compress the strand 2.

For the casting of materials such as steel having high melting points, it is preferred for the substance 5 to be in the form of a pure metal or alloy having a relatively low melting point Advantageously, the melting point of the substance 5 does not exceed about 500° C. for the casting of steel. While it is possible to use materials having higher melting points, the energy required to melt the substance 5 may become excessive. Furthermore, the temperature gradient between the strand 2 and the bath of the substance 5 may become too small for efficient cooling of the strand 2 if the melting point of the substance 5 is too high.

The specific gravity of the substance 5 at room temperature may lie in the range of about 1 to 10 for the casting of steel. Preferably, however, the specific gravity of the substance 5 at room temperature is in the range of about 5 to 8 since the effectiveness of the bath in counteracting the metallostatic pressure of the molten core of the strand 2 is then enhanced.

Figure 2:
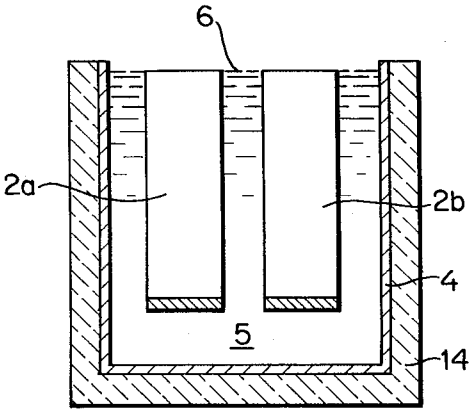
FIG. 2 is a schematic transverse sectional view of another continuous casting apparatus in accordance with the invention.

Tin and zinc are particularly well-suited as the substance 5 for the casting of steel. Other materials which may be used as the substance 5 for the casting of steel are the alloys of tin, e.g. 97 Sn-3 Cu and 67.8 Sn-33 Cd; the alloys of zinc, e.g. 95 Zn-5 Al; indium and its alloys, e.g. 97 In-3 Ag; and lead-based alloys, e.g. 43 Pb-43 Sn-14 Bi The casting apparatus of FIG. 1 is assumed to be a single-strand machine. However, the invention is equally applicable to multiple-strand machines. This is schematically illustrated in FIG. 2 where a pair of strands 2*a*,2*b* formed in a two-strand casting apparatus are advanced through a common bath of the substance 5. Alternatively to the showing of FIG. 2, a separate tank 4 and a separate bath of the substance 5 may be provided for each of the strands 2a,2b. If a casting apparatus has more than two strands, a single tank 4 or any suitable distribution of a plurality of tanks 4 may be used to cool the various strands.

Figure 3B:
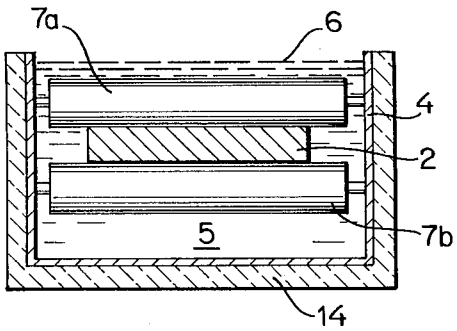
FIGS. 3*a* and 3*b* show different guide roller arrangements for use in the apparatus of FIGS. 1 and 2.
Figure 3A:
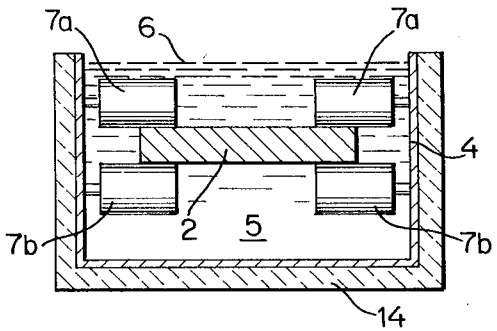

The skids 8 of FIG. 1 may be replaced by rollers 7a. As illustrated in FIG. 3a, the guide rollers 7a,7b may be cantilevered. Each of the guide rollers 7a,7b of FIG. 3a is designed in such a manner as to only partially traverse the path A of the strand 2 so that the latter is supported at its marginal regions but not at its central region. On the other hand, FIG. 3b shows that it is possible for the guide rollers 7a,7b to be supported at both ends and to traverse the path A completely thereby supporting the strand 2 across its width. A combination of cantilevered and non-cantilevered guide rollers may also be used.

Figure 4A:
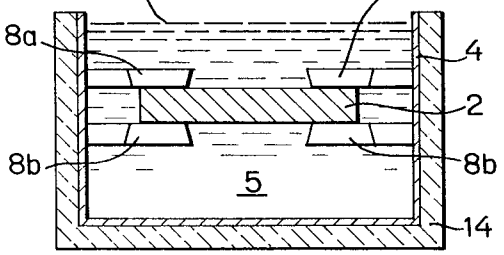
FIGS. 4*a* and 4*b* illustrate different arrangements of guide skids for use in the apparatus of FIGS. 1 and 2.
Figure 4B:
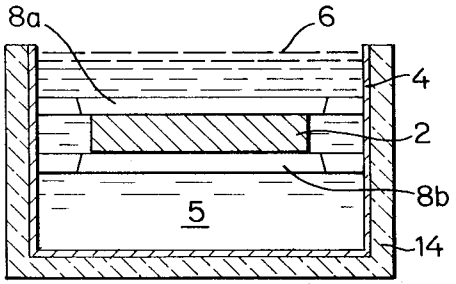

FIGS. 4a and 4b show that the strand 2 may be supported on both sides by skids 8a,8b. In FIG. 4a, the skids 8a,8b are mounted in cantilever fashion and are designed so that they extend only partly across the path A of the strand 2. The strand 2 is thus supported at its marginal regions but is unsupported at its central region. In FIG. 4b, on the contrary, each skid 8a,8b is supported at either end and extends across the full width of the path A so that the strand 2 is supported over its width.

Figure 5:
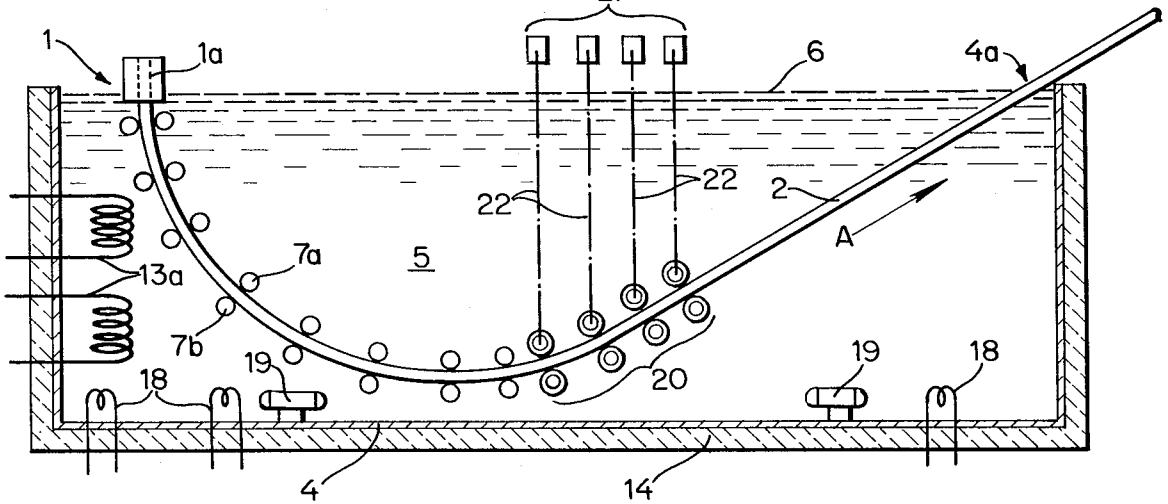
FIG. 5 is a schematic longitudinal sectional view of an additional continuous casting apparatus according to the invention.

FIG. 5 illustrates a continuous casting apparatus which generally resembles that of FIG. 1. However, the heating and circulating units 12 of FIG. 1 are replaced by heating elements 18, e.g. resistance elements, and circulating pumps 19 which are separate from the heating elements 18. Furthermore, the continuous casting apparatus of FIG. 5 has heat exchangers 13a which are designed to generate steam. The steam produced in the heat exchangers 13a may, for example, be used in the operation of plant utilities. The continuous casting apparatus of FIG. 5 additionally differs from the apparatus of FIG. 1 in that the withdrawal unit 10 and straightening section 7c of FIG. 1 are combined in a single withdrawal and straightening unit 20. The withdrawal and straightening unit 20 is located in the substance 5 entirely. A drive unit 21 for the withdrawal and straightening unit 20 is disposed above the tank 4, e.g. on the casting platform. The withdrawal and straightening unit 20 is made up of several pairs of cooperating rollers, and the drive unit 21 includes a separate motor for each pair of rollers. Each motor is connected to at least one roller of the respective roller pair by a coupling mechanism 22.

Figure 6:
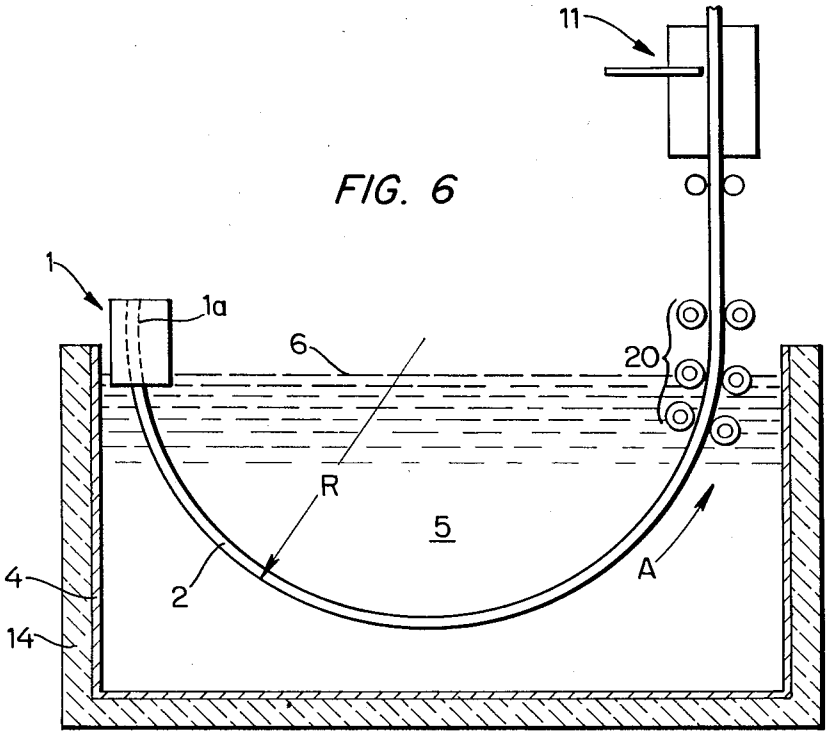
FIG. 6 is a schematic longitudinal sectional view of a further continuous casting apparatus in accordance with the invention.

FIG. 6 shows a continuous casting apparatus similar to those of FIGS. 1 and 5. In the apparatus of FIG. 6, however, the strand 2 is not straightened in the bath of the substance 5 and maintains a constant curvature until it leaves the bath. The radius of curvature of the strand 2 as it travels through the bath is the casting radius R which is the radius of curvature of the casting passage 1a. By maintaining the curvature of the strand 2 throughout the bath, it becomes possible for the withdrawal and straightening unit 20 to be only partially immersed in the bath or to be located outside of the bath entirely. This facilitates access to the withdrawal and straightening unit 20.

In contrast to the continuous casting apparatus of FIGS. 1 and 5 where the torch unit 11 is located to the side of the tank 4, the torch unit 11 in the apparatus of FIG. 6 is mounted above the tank 4 on a non-illustrated support. The cut sections of the strand 2 issuing from the torch unit 11 in the apparatus of FIG. 6 may, for example, be removed from the apparatus via a crane. During the cutting operation, the section being cut may be gripped by the crane or by a pair of rollers to prevent it from falling once the cut has been completed.

Figure 7:
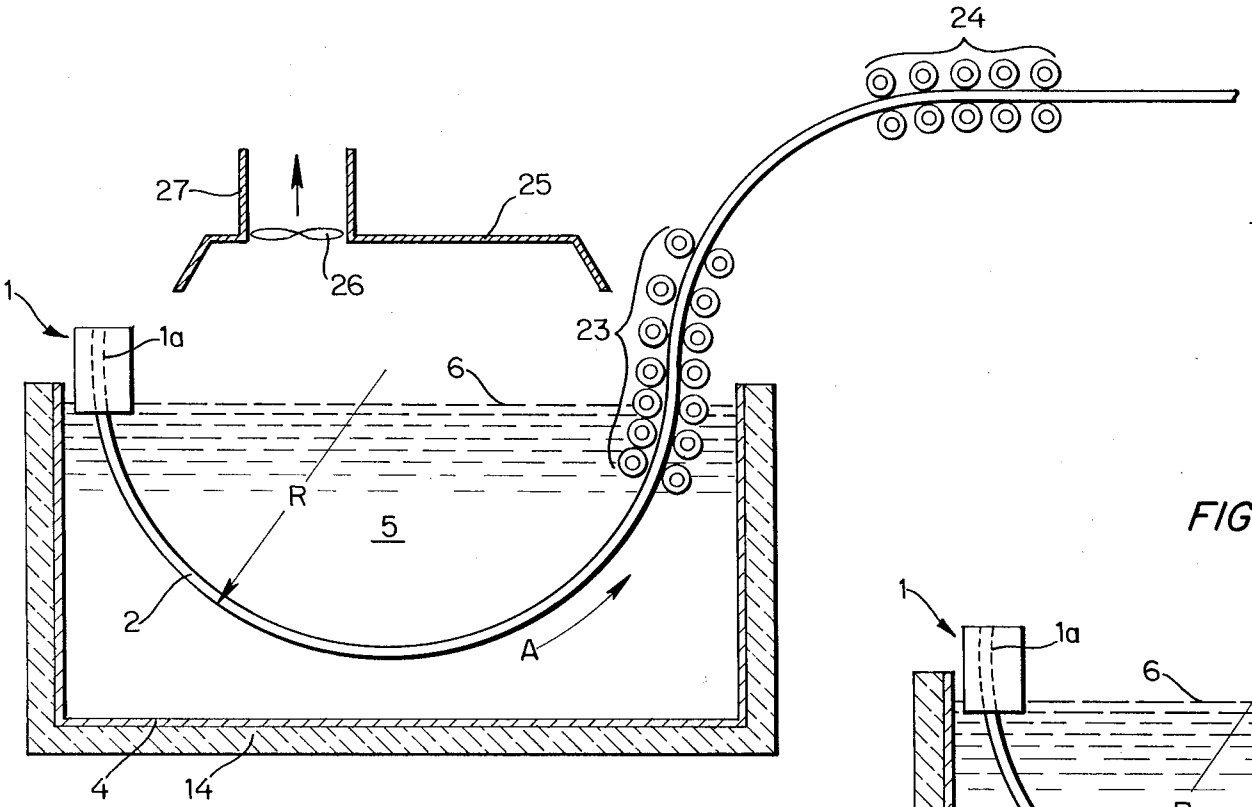
FIG. 7 is a schematic longitudinal sectional view of a different continuous casting apparatus according to the invention.

FIG. 7 illustrates a continuous casting apparatus in which the curvature of the strand 2 is maintained throughout the bath of the substance 5 but which is designed so as to permit placement of the torch unit 11 to the side of the tank 4 rather than above the latter. To this end, the apparatus of FIG. 7 is provided with a bending unit 23 which reverses the curvature of the strand 2 thereby causing the strand 2 to travel towards the side of the tank 4 after leaving the bath. The bending unit 23 may be partially immersed in the bath as shown or may be disposed outside of the bath in its entirety. The bending unit 23 is made up of pairs of cooperating rollers, and these rollers may all be idler rollers or may include at least one driven roller. If the bending unit 23 is provided with one or more driven rollers, it may also function as a withdrawal unit.

A straightening unit 24 is located downstream of the bending unit 23 and serves to straighten the strand 2. The straightening unit 24, which is optional, is again made up of pairs of cooperating rollers. The rollers of the straightening unit 24 may all be idler rollers or may include at least one driven roller. In the latter case, the straightening unit 24 may perform a withdrawal function.

The torch unit 11, which is not illustrated in FIG. 7, is arranged downstream of the straightening unit 24 and hence to the side of the tank 4.

The apparatus of FIG. 7 includes a hood 25 for the evacuation of fumes which may be generated by the bath of the substance 5. The hood 25, which is located above the tank 4, is provided with a blower 26. The blower 26 draws the fumes generated by the bath into a duct 27 which leads to a conventional air purification system.

Figure 8:
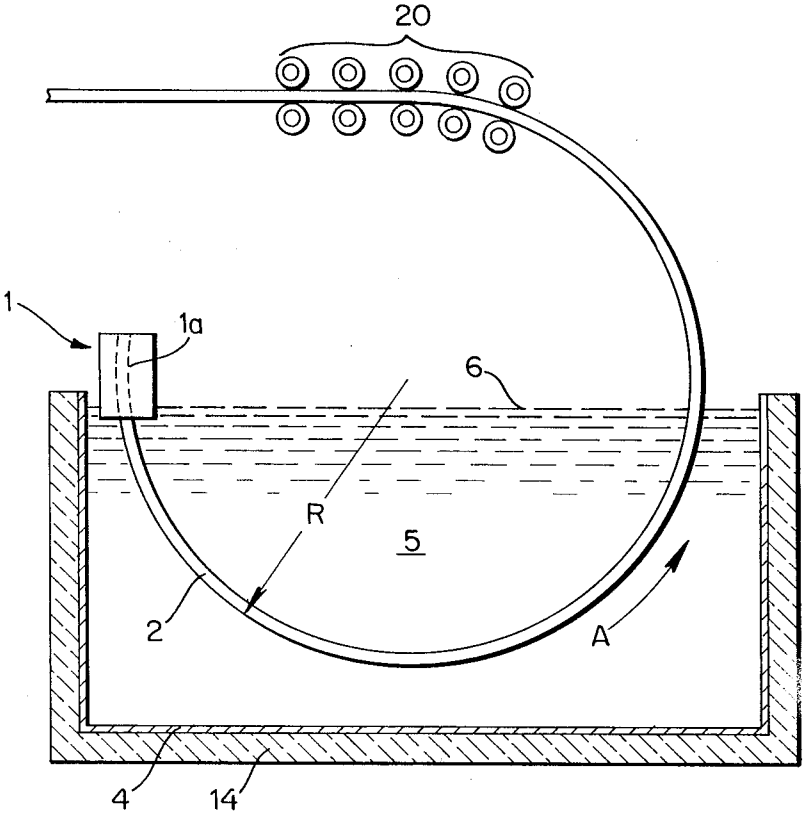
FIG. 8 is a schematic longitudinal sectional view of yet another continuous casting apparatus in accordance with the invention.

FIG. 8 shows a continuous casting apparatus which is similar to those of FIGS. 6 and 7 in that the curvature of the strand 2 is maintained throughout the bath of the substance 5. However, contrary to the apparatus of FIGS. 6 and 7, the strand 2 in the apparatus of FIG. 8 is permitted to retain its curvature after leaving the bath so that the strand 2 turns back towards the mold 1. The withdrawal and straightening unit 20 which may, for example, be mounted on a special platform above the casting platform, is arranged to straighten the strand 2 before the latter again begins to travel downwards. The torch unit 11, which is not shown in FIG. 8, is located downstream of the withdrawal and straightening unit 20 and may likewise be mounted on a special platform disposed at a level above the casting platform.

Figure 9:
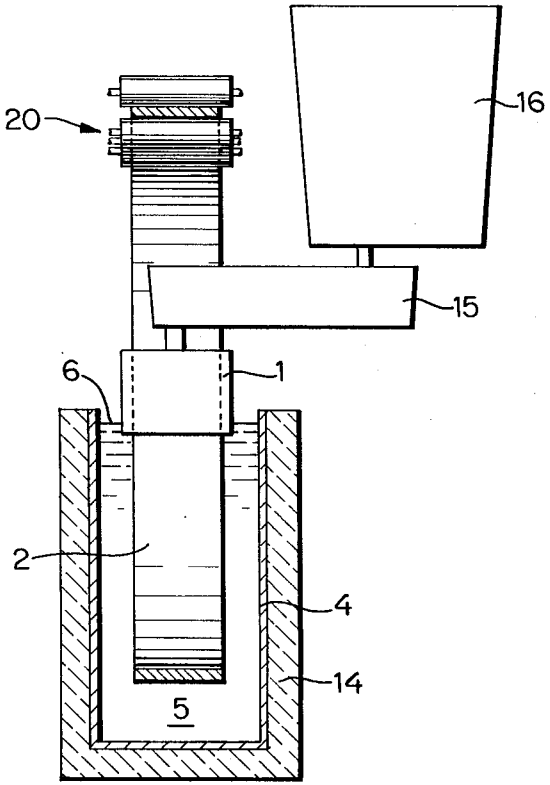
FIG. 9 illustrates an arrangement of teeming vessels for use in the apparatus of FIG. 8.

The path A followed by the strand 2 in the apparatus of FIG. 8 passes directly over the mold 1. Normally, the space directly above the mold 1 is occupied by the ladle 16 during casting. In order to prevent obstruction of the strand 2 by the ladle 16, the latter may be shifted to one side of the mold 1 as illustrated in FIG. 9. The tundish 15 is then positioned in such a manner that one end thereof is situated above the mold 1 while the other end is located below the ladle 16. This enables the molten metal to be teemed from the ladle 16 into the mold 1 via the tundish 15 even though the ladle 16 has been shifted to one side of the mold 1.

Figure 10:
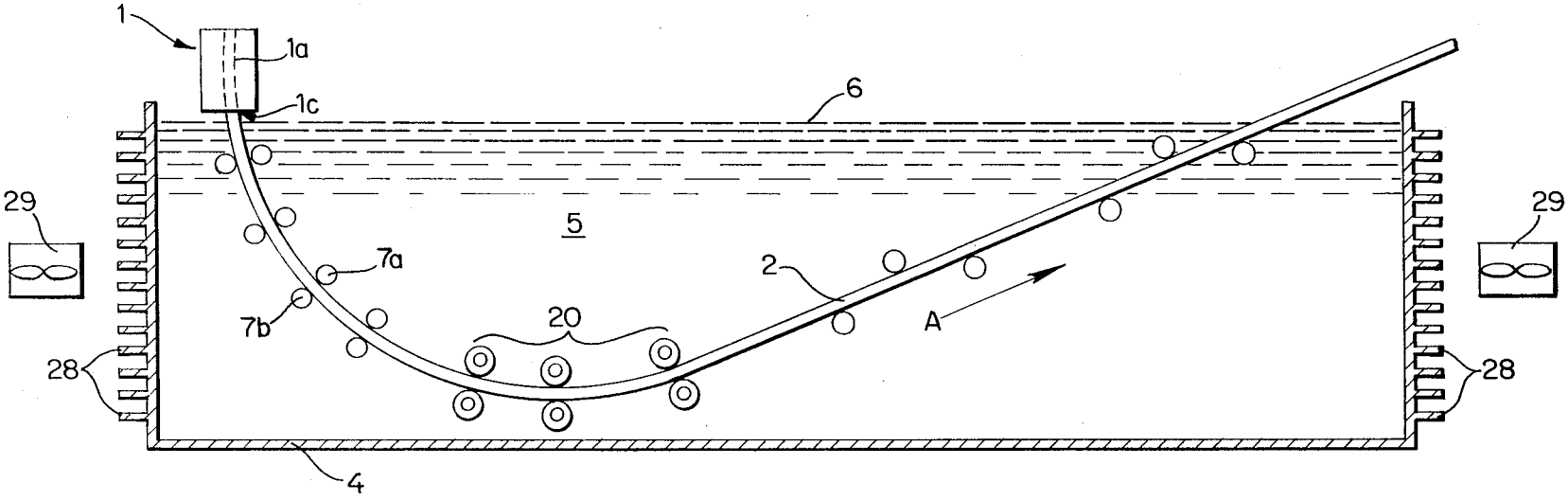
FIG. 10 is a schematic longitudinal sectional view of still a further continuous casting apparatus, according to the invention.

FIG. 10 shows a continuous casting apparatus in which heat is removed from the bath of the substance 5 through the peripheral walls of the tank 4. The peripheral walls of the tank 4 in the apparatus of FIG. 10 are uninsulated. In order to accelerate the removal of heat from the bath, the peripheral walls of the tank 4 may be provided with cooling fins 28. Moreover, ventilators 29 for forcing cool air over the fins 28 may be mounted on or adjacent to the peripheral walls of the tank 4.

It is possible to omit heat exchangers from the tank 4 in the apparatus of FIG. 10. However, if further acceleration in the removal of heat from the bath of the substance 5 is desired, this may be accomplished by placing heat exchangers in the tank 4.

In the apparatus of FIG. 10, the outlet end 1*c* of the mold 1 is located above the upper surface 6 of the substance 5. The outlet end 1*c* may, of course, be similarly positioned in the apparatus of FIGS. 1 and 5–9 while, conversely, the outlet end 1*c* in the apparatus of FIG. 10 may be located at or below the upper surface 6 of the substance 5.

Figure 12:
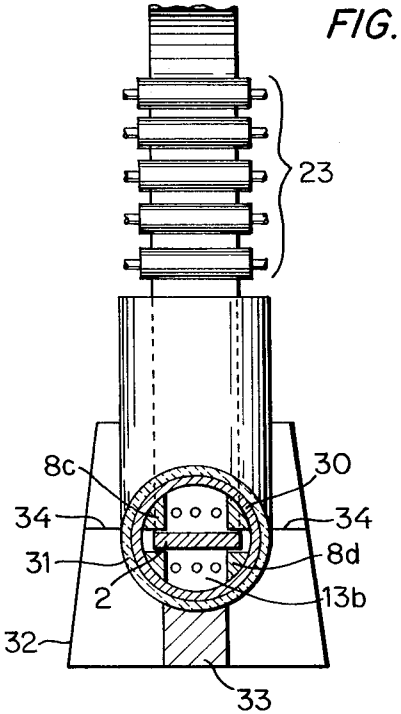
FIG. 12 is a sectional view in the direction of the arrows XII—XII of FIG. 11.
Figure 11:
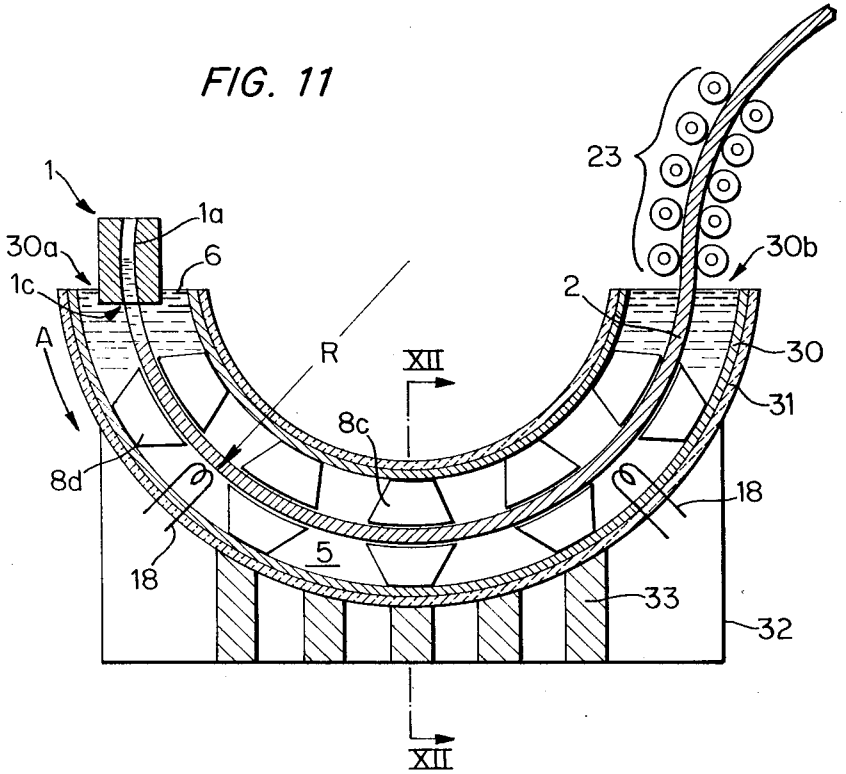
FIG. 11 is a schematic longitudinal sectional view of an additional continuous casting apparatus in accordance with the invention.

FIGS. 11 and 12 illustrate a continuous casting apparatus in which the tank 4 is replaced by a pipe 30. The interior of the pipe 30 accommodates the substance 5 for cooling the strand 2 formed in the mold 1. The interior of the pipe 30 further accommodates guide means for the strand 2. The guide means is here in the form of skids 8*c* arranged to engage that surface of the strand 2 which forms adjacent to the inner radius of the casting passage 1*a*, and skids 8*d* arranged to engage that surface of the strand 2 which forms adjacent to the outer radius of the casting passage 1*a*. The skids 8*c* and 8*d*, which are shown as engaging only the marginal regions of the strand 2, are secured to the inner surface of the pipe 30, e.g. by welding.

The pipe 30 has an inlet end 30*a* through which the strand 2 enters the pipe 30, and an outlet end 30*b* via which the strand 2 exits from the pipe 30. The inlet end 30*a* is closed except for an opening dimensioned to snugly receive the outlet end 1*c* of the mold 1. Similarly, the outlet end 30*b* is closed except for an opening through which the strand 2 is withdrawn from the pipe 30. The pipe 30 has a curvature which corresponds to that of the casting passage 1*a*, and hence to the curvature of the strand 2.

Heating elements 18 are disposed internally of the pipe 30 in order to supply heat to the substance 5. Although not illustrated in FIGS. 11 and 12, it is further possible to place circulating pumps inside the pipe 30 to effect circulation of the bath formed by the substance 5. Combined heating and circulating units such as shown at 12 in FIG. 1 may also be employed in the pipe 30.

The apparatus of FIGS. 11 and 12 is designed for the recovery of heat from the strand 2. To this end, a heat exchange system is located inside the pipe 30. The heat exchange system includes a series of conduits 13*b* which extend lengthwise of the pipe 30 and carry a cooling fluid, e.g. water. In order to reduce heat losses through the walls of the pipe 30, the latter is surrounded by an insulating jacket 31.

If heat recovery from the strand 2 is not desired, the insulating jacket 31 may be eliminated and the pipe 30 provided with cooling fins such as shown at 28 in FIG. 10. Ventilators like those identified at 29 in FIG. 10 may then also be disposed adjacent to the pipe 30.

A pair of diametrically opposed flanges 34 is formed on the pipe 30. The flanges 34 rest on a base 32 which serves to support the pipe 30. Added support for the pipe 30 may be provided by a series of columns 33 which are spaced along the base 32 and engage the pipe 30 from below.

The pipe 30 is illustrated as having a circular cross section. However, this is by way of example only, and the pipe 30 may have any other type of cross section, e.g. polygonal.

The continuous casting apparatus of FIGS. 11 and 12 has the advantage that cooling of the strand 2 may be achieved using smaller amounts of the substance 5 than in the apparatus of FIGS. 1, 2 and 5–10. In addition to the savings in material which may be realized by using smaller amounts of the substance 5, energy costs may be reduced since less energy is required to heat the substance 5 and maintain it at temperature prior to and between casts. Moreover, the time required to heat the substance 5 may be reduced. Another advantage of the apparatus of FIGS. 11 and 12 is that less surface area of the substance 5 is exposed to the atmosphere.

The manner in which the heating and circulating units 12, the heating elements 18 and the pumps 19 are connected with external power sources via the walls of the tank 4 and the pipe 30 does not form part of the invention per se, and conventional stationary seals may be used for this purpose. The same applies to the manner in which the conduits of the heat exchangers 13,13*a*,13*b* are passed through the walls of the tank 4 and the pipe 30.

In continuous casting apparatus such as those illustrated in FIGS. 5 and 10 where driven rollers are located inside the tank 4, the rollers may be rotated by motors located either above or to the side of the tank 4. If the motors are situated to the side of the tank 4, conventional dynamic seals may be employed to couple the motors with the driven rollers via a wall of the tank 4.

Situations may arise where it is desirable to use a substance 5 having a specific gravity which is significantly lower than that of the material being cast. Under such circumstances, a supply of the substance 5 may be confined in a vessel which is located at a level above and is in communication with the tank 4 or the pipe 30. The additional head of the substance 5 obtained in this manner may partially or entirely compensate for the difference in specific gravity depending upon the magnitude of the difference and the height differential of the vessel and the mold 1. This, in turn, enables better confinement of the molten core of the strand 2 to be achieved. The tank 4 or pipe 30 must be appropriately sealed in order to prevent escape of the bath formed by the substance 5.

Although the invention has been described with reference to vertical continuous casting apparatus, the invention is applicable to horizontal as well as other types of continuous casting apparatus.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. A continuous casting apparatus comprising:

(a) a mold provided with a casting passage having an inlet end for molten material, and an outlet end for a continuously cast strand of the material, said mold being designed for the continuous casting of steel;

(b) withdrawal means for withdrawing the strand from said mold and conveying the strand along a predetermined path; and (c) cooling means for cooling the strand downstream of said mold, said cooling means including container means, and a non-gaseous cooling substance in said container means surrounding and contacting at least a portion of said path, said substance being capable of adhering to the strand so as to form a coating on the latter, and said substance having a boiling point lower than the melting point of the strand to thereby permit removal of the coating by heating, said substance comprising zinc.

2. The apparatus of claim 1, wherein the melting point of said substance is at most about 500° C.

3. The apparatus of claim 1, wherein said cooling means comprises heat exchanger means in contact with said substance.

4. The apparatus of claim 1, comprising heating means for melting said substance.

5. The apparatus of claim 9, wherein said heating means is disposed in said substance.

6. The apparatus of claim 1, comprising circulating means for circulating said substance when the latter is in liquid form.

7. The apparatus of claim 6, wherein said circulating means is disposed in said substance.

8. The apparatus of claim 1, comprising guide means for the strand, at least a portion of said guide means being disposed in said substance.

9. The apparatus of claim 8, wherein said guide means comprises skids.

10. The apparatus of claim 8, wherein said guide means comprises rollers.

11. The apparatus of claim 1, said mold being curved so that the strand has a curvature upon issuing from said mold; and further comprising straightening means for the strand, at least a portion lf said straightening means being disposed in said substance.

12. The apparatus of claim 1, wherein at least a portion of said withdrawal means is disposed in said substance.

13. The apparatus of claim 12, said withdrawal means including at least one driven roller; and wherein said roller is disposed in said substance.

14. The apparatus of claim 1, wherein said container means comprises a tank.

15. The apparatus of claim 1, wherein said container means comprises a tube.

16. The apparatus of claim 1, comprising insulating means for said container means.

17. The apparatus of claim 1, said container means having a peripheral wall; and wherein said cooling means comprises removing means for removing heat from said peripheral wall.

18. The apparatus of claim 17, wherein said removing means comprises cooling fins on said peripheral wall.

19. The apparatus of claim 1, comprising exhaust means for exhausting fumes from said container means.

20. A continuous casting method comprising the steps of:

(a) continuously introducing molten material into one end of a casting passage having another end which is spaced from said one end;

(b) cooling said material in said passage to form a continuously cast strand;

(c) continuously withdrawing said strand from said passage via said other end;

(d) cooling said strand subsequent to withdrawal from said passage by immersing said strand in a bath, said bath including a substance capable of adhering to said strand; and (e) withdrawing said strand from said bath while said substance adheres thereto so that said substance forms a coating on said strand, said substance having a boiling point lower than the melting point of said strand to thereby permit removal of said coating by heating.

21. The method of claim 20, wherein said material comprises steel and said substance comprises zinc.

22. The method of claim 20, wherein said substance comprises a metal.

23. The method of claim 20, wherein said substance has a melting point of at most about 500° C.

24. The method of claim 20, wherein the strand cooling step comprises removing heat from said bath.

25. The method of claim 24, wherein the removing step comprises effecting indirect heat exchange between said bath and a cooling medium.

26. The method of claim 20, comprising the strand step of solidifying said bath subsequent to the cooling step.

27. The method of claim 20, comprising the step of circulating said bath.

28. The method of claim 20, comprising the step of guiding said strand in said bath.

29. The method of claim 20, said passage being curved so that said strand has a curvature upon issuing from said passage; and further comprising the step of at least partially straightening said strand in said bath.

30. The method of claim 20, wherein the second withdrawing conveying step comprises exerting a withdrawal force on said strand in said bath.

31. The method of claim 20, comprising the step of exhausting fumes from said bath.

32. The method of claim 20, comprising the step of supplying heat to said bath prior or subsequent to the strand cooling step to prevent solidification of said bath.

* * * * *